US005330190A

United States Patent [19]

Oakley, Jr.

[11] Patent Number: 5,330,190

[45] Date of Patent: Jul. 19, 1994

[54] END WEIGHTED GOLF TRAINER

[76] Inventor: George W. Oakley, Jr., 109 Ramblin Rd., Salisbury, Md. 21801

[21] Appl. No.: 115,584

[22] Filed: Sep. 3, 1993

[51] Int. Cl.[5] ..... A63B 69/36

[52] U.S. Cl. ..... 273/186.2; 273/193 A

[58] Field of Search ..... 273/186.2, 186.3, 193 A, 273/194 R, 194 A, 194 B, 193 B; 482/109

[56] References Cited

U.S. PATENT DOCUMENTS

| | | | |
|---|---|---|---|
| 3,498,616 | 3/1970 | Hurst | 273/186.2 |
| 4,602,788 | 7/1986 | Wendt | 273/193 A |
| 4,953,868 | 9/1990 | Thompson et al. | 273/186.2 |
| 5,026,063 | 6/1991 | Rhodes | 273/193 A X |

*Primary Examiner*—George J. Marlo
*Attorney, Agent, or Firm*—Hugh E. Smith

[57] ABSTRACT

A device for use in training a golfer when the golfer is repeating a golf swing, as in a confined space, without a golf club, comprising, a central tube fabricated of plastic polyvinylchloride with a wall diameter and thickness to allow limited resilience and flexibility, the central tube having a pair of apertures therethrough radially aligned at each end; a first end tube fabricated of plastic having a pair of apertures at its axial interior end aligned with the apertures at the first end of the central tube and with an interior wall diameter to fit over the end of the central tube, and a single weight at the end thereof; a second end tube fabricated of plastic and having a pair of apertures at its axially exterior end aligned with the apertures at the second end of the central tube and with an exterior diameter to fit within the first end of the central tube and a plurality of weights at the axially exterior end thereof, the second elongated tube having greater flexibility than that of the first end tube; and fastener means positionable through the aligned holes of the three tubes for releasably coupling them along a common axis. The central tube may also contain a tubular member in which a marble is located for movement within the interior space upon the tipping of the device in one direction or another.

5 Claims, 4 Drawing Sheets

END WEIGHTED GOLF TRAINER

BACKGROUND OF THE INVENTION

1. Field of the Invention

The present invention relates to an end weighted golf trainer and more particularly pertains to a device for being supported by a golfer when practicing a golf swing.

2. Description of the Prior Art

The use of golf trainers are well known in the prior art. More specifically, golf trainers heretofore devised and utilized for the purpose of training a golfer in a repeatable swing are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,109,244 Trifaro discloses a training aid for a golfer which is positionable across the small of the back and held into position by the crook of the arms at the elbows of the player. U.S. Pat. No. 3,820,781 to Kane as well as U.S. Pat. No. 4,440,391 to Saenz both relate to exercise devices not necessarily pertinent to golf which involves symmetrically oriented devices positioned across the back of the neck of the user. Such devices appear to be equally weighted and are not suitable for use as a golf training aid.

In this respect, the golf trainer according to the present invention substantially departs from the conventional concepts and designs of the prior art, and in so doing provides an apparatus primarily developed for the purpose of practicing a repeatable swing.

Therefore, it can be appreciated that there exists a continuing need for new and improved trainers which can be used by golfers' away from the golf course. In this regard, the present invention substantially fulfills this need.

SUMMARY OF THE INVENTION

In view of the foregoing disadvantages inherent in the known types of golf training devices now present in the prior art, the present invention provides an improved trainer construction wherein the same can be utilized for swing repetition in a confined space with weighting of the device to simulate the golf swing. As such, the general purpose of the present invention, which will be described subsequently in greater detail, is to provide a new and improved golf training apparatus and method which has all the advantages of the prior art exercise and training devices and none of the disadvantages.

To attain this, the present invention essentially comprises a device for use in training a golfer when the golfer is repeating a golf swing, as in a confined space, without a golf club, comprising: a central tube fabricated of polyvinylchloride with a wall diameter and thickness to allow limited resilience and flexibility, the central tube having a pair of apertures therethrough radially aligned at each end; a tubular cover positioned over the central tube, the length of the cover being less than that of the central tube to expose the apertures at the ends of the central tubes, the cover being fabricated of a soft elastomeric material; a first end tube fabricated of polyvinylchloride having a pair of apertures at its axially interior end aligned with the apertures at the first end of the central tube and with an interior wall diameter to fit over the end of the central tube, and a single weight at its axially exterior end; a second end tube fabricated of polyvinylchloride and having a pair of apertures at its axially interior end aligned with the apertures at the second end of the central tube and with an exterior diameter to fit within the second end of the central tube, and a plurality of weights at the axially exterior end thereof, the second elongated tube having greater flexibility than that of the first end tube; and fasteners positionable through the aligned holes of the three tubes for releasably coupling them along a common axis.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved end weighted golf trainer which has all the advantages of the prior art and none of the disadvantages.

It is another object of the present invention to provide a new and improved end weighted golf trainer which may be easily and efficiently manufactured and marketed.

It is a further object of the present invention to provide a new and improved end weighted golf trainer which is of a durable and reliable construction.

An even further object of the present invention is to provide a new and improved end weighted golf trainer which is susceptible of a low cost of manufacture with regard to both materials and labor, and which accordingly is then susceptible of low prices of sale to the consuming public, thereby making such trainers economically available to the buying public.

Still yet another object of the present invention is to provide a new and improved end weighted golf trainer which provides in the apparatuses and methods of the prior art some of the advantages thereof, while simultaneously overcoming some of the disadvantages normally associated therewith.

Still another object of the present invention is to simulate a golf swing in a confined space as an aid for golf training.

Yet another object of the present invention is to assist golfers in improving their swing on a constant basis.

Even still another object of the present invention is to maintain golf readiness despite the unavailability of a golf club and/or course due to location or weather.

Lastly, it is another object of the present invention to provide a device for use in training a golfer when the golfer is repeating a golf swing, as in a confined space, without a golf club, comprising: a central tube fabricated of plastic polyvinylchloride with a wall diameter and thickness to allow limited resilience and flexibility, the central tube having a pair of apertures therethrough radially aligned at each end; a first end tube fabricated of plastic having a pair of apertures at its axial interior end aligned with the apertures at the first end of the central tube and with an interior wall diameter to fit over the end of the central tube, and a single weight at the end thereof; a second end tube fabricated of plastic and having a pair of apertures at its axially exterior end aligned with the apertures at the second end of the central tube and with an exterior diameter to fit within the first end of the central tube and a plurality of weights at the axially exterior end thereof, the second elongated tube having greater flexibility than that of the first end tube; and fastener means positionable through the aligned holes of the three tubes for releasably coupling them along a common axis.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
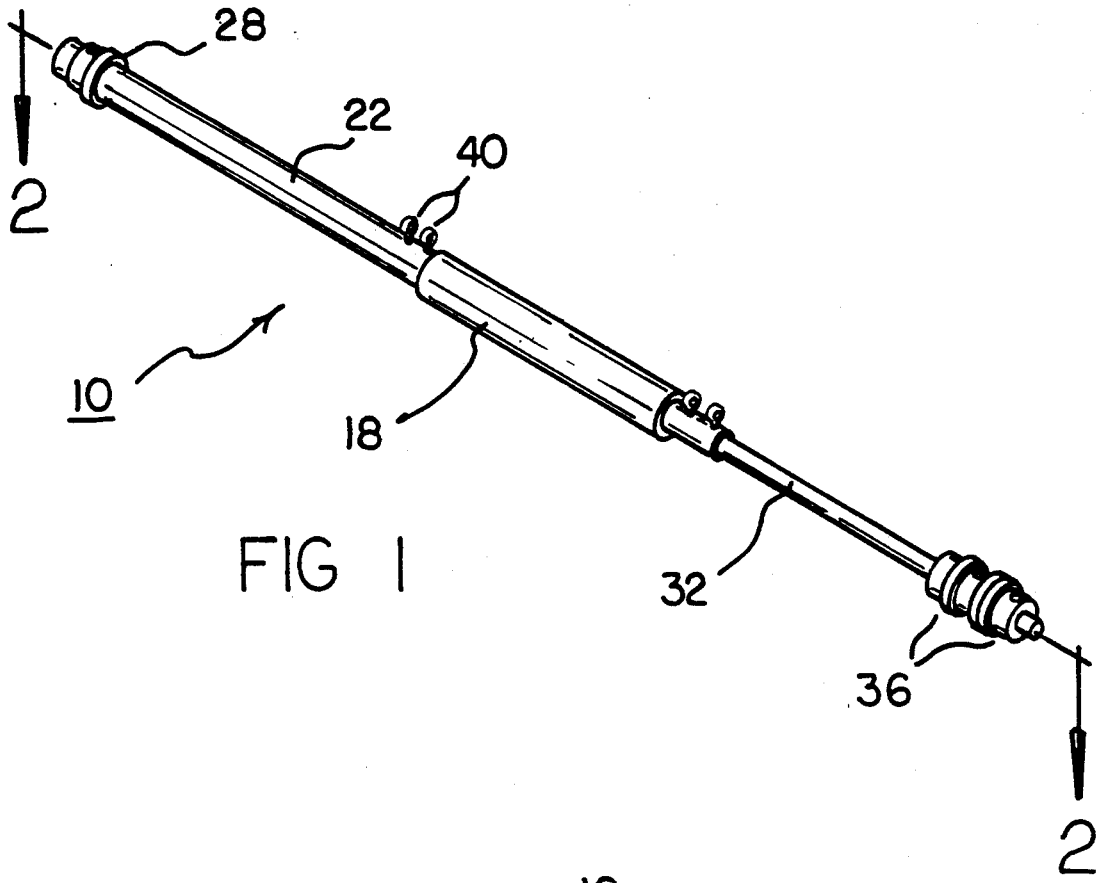
FIG. 1 is a perspective illustration of the end weighted golf trainer constructed in accordance with the principles of the present invention.

With reference now to the drawings, and in particular to FIG. 1 thereof, a new and improved end weighted golf trainer embodying the principles and concepts of the present invention and generally designated by the reference numeral 10 will be described.

Figure 2:
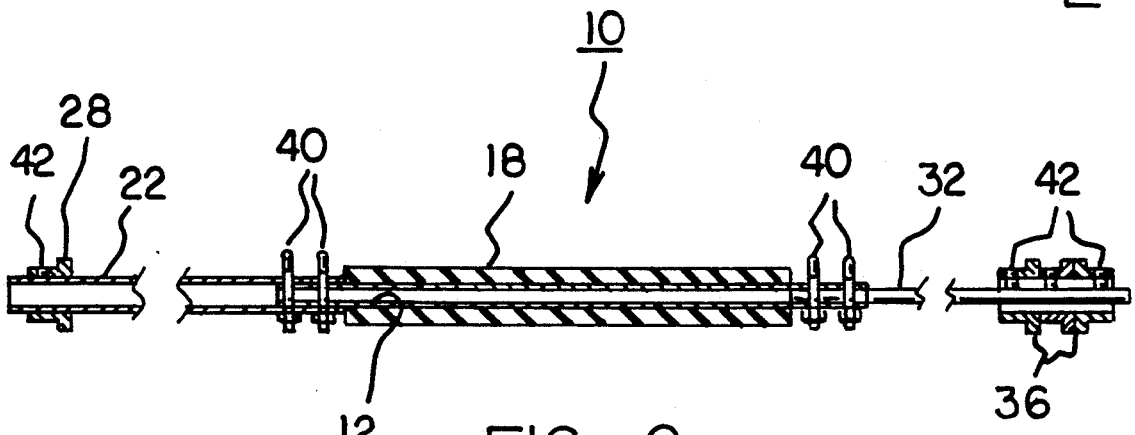
FIG. 2 is a cross sectional view of the device of FIG. 1 taken along line 2—2 of FIG. 1.
Figure 3:
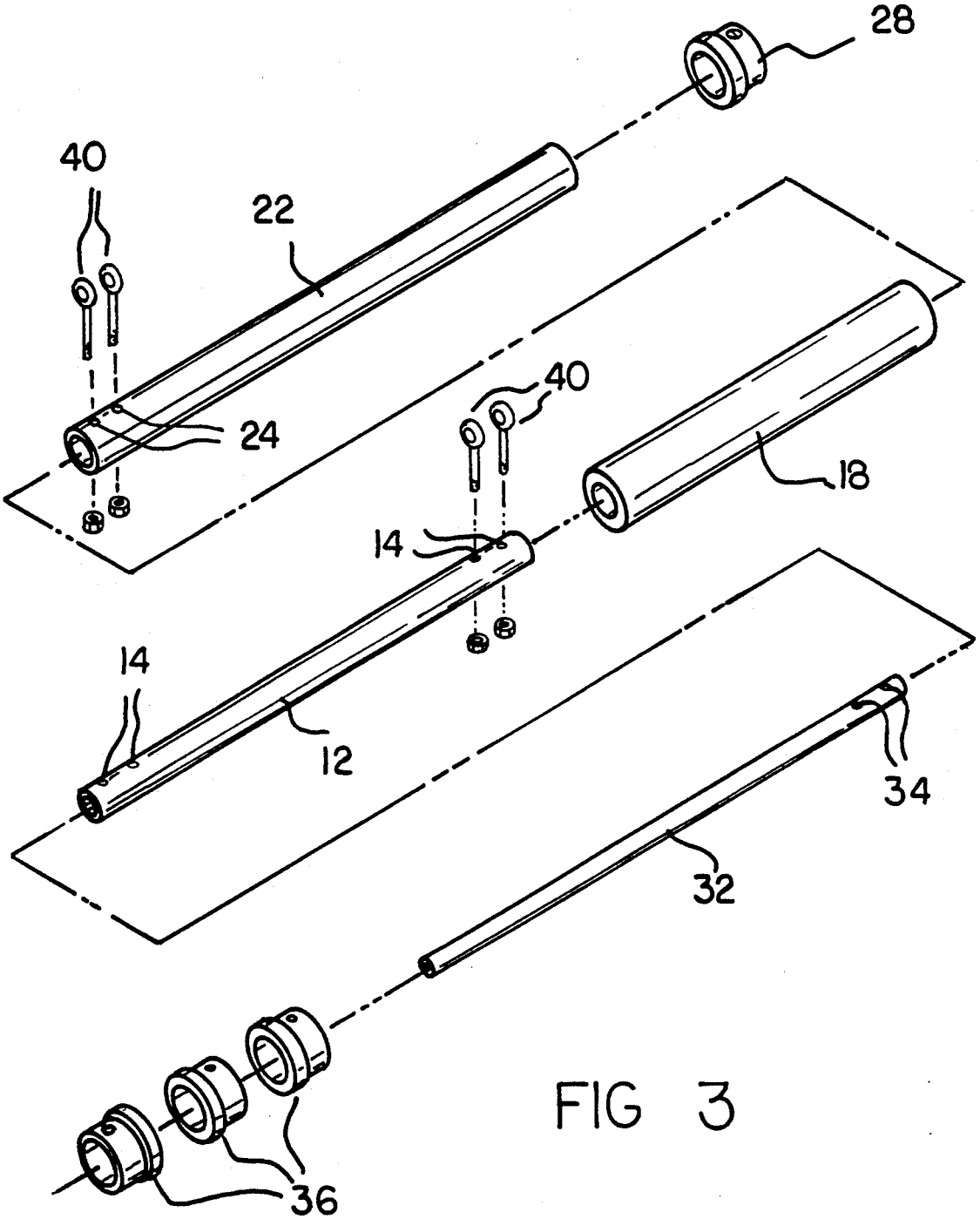
FIG. 3 is an enlarged exploded perspective illustration of the end weighted golf trainer of the prior Figures.

More specifically, it will be noted that the end weighted golf trainer 10 of the present invention is more readily understood by reference to the Figures. More particularly FIGS. 1, 2 and 3 illustrate the primary embodiment of the present invention. According to the primary embodiment, a device is provided for use in training a golfer when the golfer is repeating a swing, as in a confined space, without a golf club. The device 10 comprises a central tube 12 fabricated of a plastic, preferably polyvinylchloride. It has a wall diameter and thickness to allow limited resilience and flexibility. The central tube, 12 also has pairs of apertures 14 therethrough axially aligned at each end.

A tubular cover 18 is positioned over the central tube. The length of the cover is less than that of the central tube. This allows exposure of the apertures at the ends of the central tubes. The cover being fabricated of a soft elastomeric material.

A first end tube 22 is then provided. It is fabricated of a plastic, preferably polyvinylchloride. The first end tube has pairs of apertures 24 radially aligned at its axial interior end. The apertures 24 are aligned with the apertures 14 at the first end of the central tube. The interior wall diameter of the first end tube 22 is such to fit over the first end of the central tube. A single weight 28 is removeably positioned at the other end of the tube.

A second end tube 32 is also provided. It is fabricated of a plastic, preferably polyvinylchloride. It has pairs of apertures 34 at its axially interior end aligned with the apertures 14 at the second end of the central tube. Its exterior diameter is such as to fit within the second end of the central tube. It also has a plurality of weights 36 at the axially interior end thereof. The second elongated tube has greater flexibility than that of the first end tube.

Four fasteners 40 are positionable through the aligned holes of the three tubes for releasably coupling them along a common axis. Set screws 42 removably secure the weights to the tubes.

Figure 4:
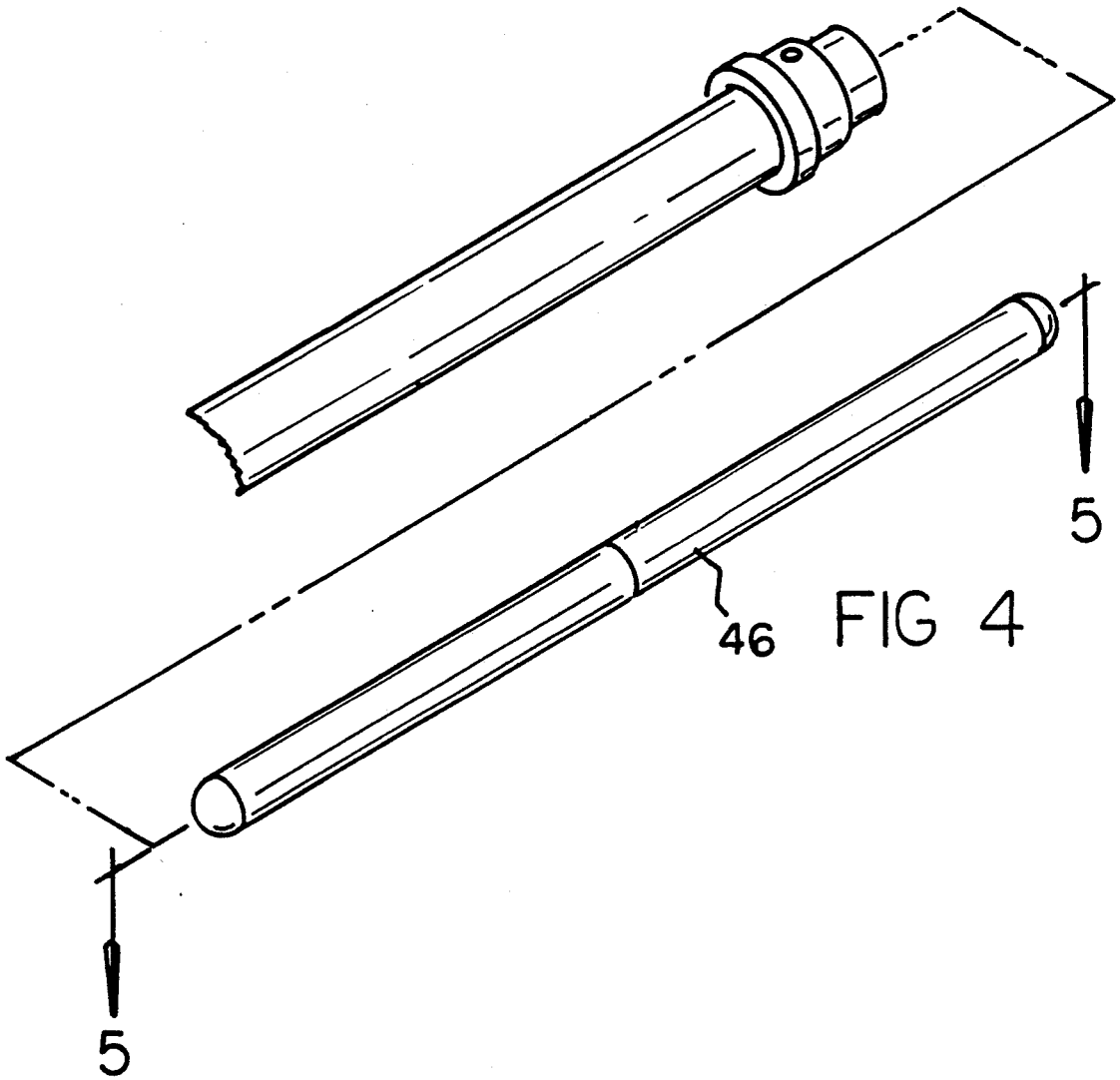
FIG. 4 is illustrates an alternate embodiment of the invention wherein a component is provided for hearing the timing of the golf swing.
Figure 5:
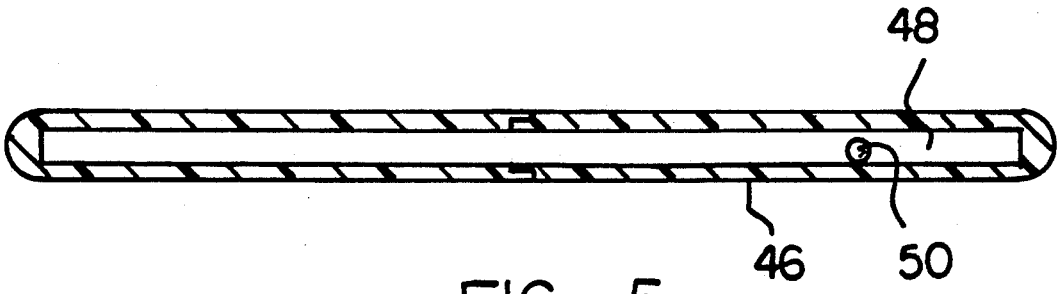
FIG. 5 is a cross sectional view of the new component of the alternate embodiment.

The apparatus further includes in the alternate embodiment of FIGS. 4 and 5, an enclosed tubular member 46 with a hollow interior space 48. A marble 50 is located within the interior space for movement upon the tipping of the tubular member in one direction or another. The tubular member 46 has a length less than the length of the central tube 12. Its exterior diameter is such as to be received and frictionally supported within the interior diameter of the central tube.

Figure 6:
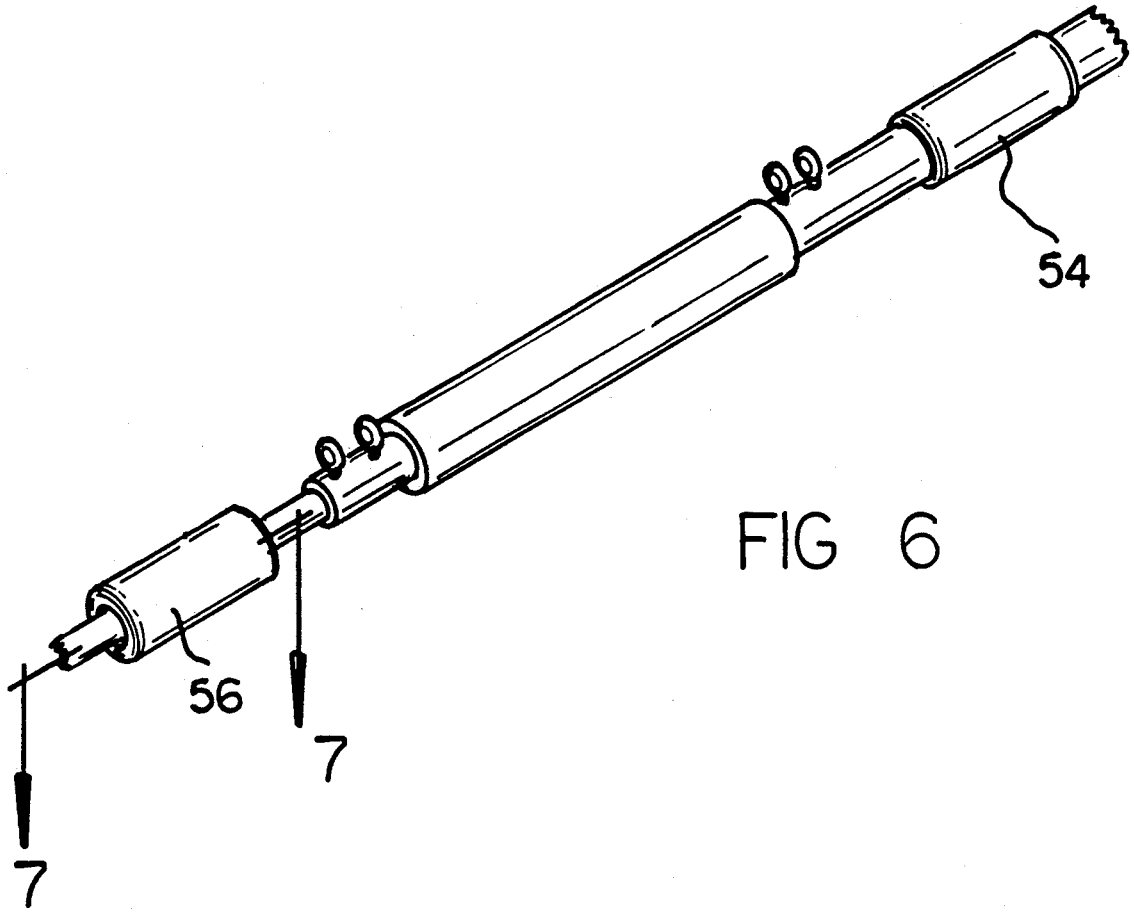
FIG. 6 is a perspective view of yet a further alternate embodiment of the invention employing additional handles.
Figure 7:
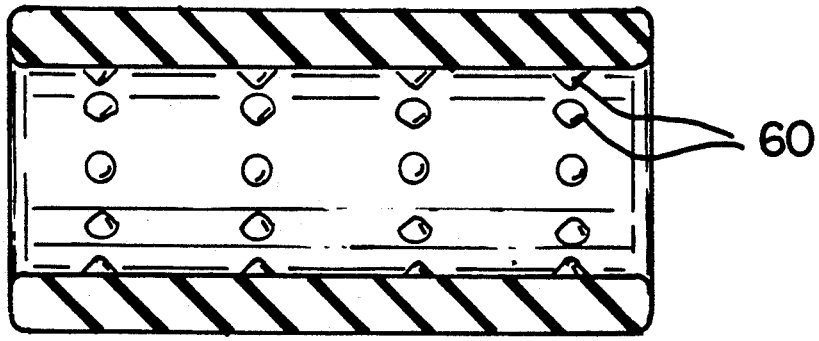
FIG. 7 is a sectional view of the additional handle of the FIG. 6 embodiment taken along line 7—7 of FIG. 6.

The apparatus further includes in the alternate embodiment of FIG. 6 and 7, a pair of handles 54 and 56. The pair of handles feature smaller handles of an interior diameter. The first handle 54 is to be received over the exterior diameter of the first end tube 22 and the second handle 56 has an interior diameter for being received on the exterior of the second end tube 32. The axial length and exterior diameter of the two tubes are essentially constant. The handles 54 and 56 further including a plurality of projections 60 extending inwardly from the interior surface for frictional contact with the exterior surface of the end tube upon which it is received for abating axial movement therebetween.

This invention relates to a training and conditioning device that is particularly adapted for use by golfers for maintaining the tone of the muscles that are involved in executing a golf swing. It is also useful to train novice golfers in the body movements that are necessary to execute a proper back-swing and follow-through.

The device is designed to closely duplicate the back-swing and follow through motions of a normal full golf swing by the use of a flexible unequally weighted tube that rest on top of the shoulders of a user just behind the neck, with a cushioned pad to protect the neck during usage. The flexible tube is right handed end weighted as much as 3 times greater than the left hand end. Flex of the tube shows when in the address position. The weight distribution should be such that the heavier end has a least 2 or 3 times more weight than the other end.

Actually the typical driver that most players use is approximately 13 ounces inclusive from the grip through and including the normal club head. If you cut the shaft in half you find that the club head or heavier end (the end that you actually hit the ball with) is approximately 61 percent of the total weight and is also attached to the most flexible end of the club. This helps create the centrifugal force when the club is swung. The weights used in the prototype are about 8.5 ounces each.

The turning of the shoulders and coiling of the torso around the spine, with added weight on the end of a flexible pole creates a natural force and action without the use of one's hands. The prototype is approximately 63 inches long and a normal driver club length is approximately 43 inches. The extra 20 inches adds length enough to be flexible and create a "ball and chain feeling" when making the coiling and recoiling motions or turn and return motions. The hands of the user simply lightly hold on as the back-swing and follow through take place.

An advantage of the flexible end weighted golf trainer is that it may be used in about one third less space than a normal full swing would require and at the same time its use trains and conditions a beginning or seasoned golfer with less effort and in much less time than it would take to learn actually hitting balls. One may take as many as 50 swinging motions in approximately six minutes. One could use it as an ideal off season conditioner, use it in the office, in the bedroom, or at the course just prior to playing as a quick warmup.

Additional advantages of the device is that it builds tempo into the swing in an unconscious effort. The flexibility of the device and the one heavy-end generates a natural tempo when the device is swung with the littlest of effort.

The weights and length may be altered for age and strength of user; however the weight distribution ratio must be adjusted accordingly. The device is collapsible for travel and storage purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for use in training a golfer when the golfer is repeating a golf swing, as in a confined space, without a golf club, comprising:

a central tube fabricated of polyvinylchloride with a wall diameter and thickness to allow limited resilience and flexibility, the central tube having a pair of apertures therethrough radially aligned at each end;

a tubular cover positioned over the central tube, the length of the cover being less than that of the central tube to expose the apertures at the ends of the central tubes, the cover being fabricated of a soft elastomeric material;

a first end tube fabricated of polyvinylchloride having a pair of apertures at its axially interior end aligned with the apertures at the first end of the central tube and with an interior wall diameter to fit over the end of the central tube, and a single weight at its axially exterior end;

a second end tube fabricated of polyvinylchloride and having a pair of apertures at its axially interior end aligned with the apertures at the second end of the central tube and with an exterior diameter to fit within the second end of the central tube, and a plurality of weights at the axially exterior end thereof, the second elongated tube having greater flexibility than that of the first end tube; and fasteners positionable through the aligned holes of the three tubes for releasably coupling them along a common axis.

2. A device for use in training a golfer when the golfer is repeating a golf swing, as in a confined space, without a golf club, comprising:

a central tube fabricated of plastic polyvinylchloride with a wall diameter and thickness to allow limited resilience and flexibility, the central tube having a pair of apertures therethrough radially aligned at each end;

a first end tube fabricated of plastic having a pair of apertures at its axial interior end aligned with the apertures at the first end of the central tube and with an interior wall diameter to fit over the end of the central tube, and a single weight at the end thereof;

a second end tube fabricated of plastic and having a pair of apertures at its axially exterior end aligned with the apertures at the second end of the central tube and with an exterior diameter to fit within the first end of the central tube and a plurality of weights at the axially exterior end thereof, the second elongated tube having greater flexibility than that of the first end tube; and fastener means positionable through the aligned holes of the three tubes for releasably coupling them along a common axis.

3. The apparatus as set forth in claim 2 and further including an enclosed tubular member with a hollow interior space and a marble located within the interior space for movement upon the tipping of the tubular member in one direction or another, the tubular member having a length less than the length of the central tube and a exterior diameter, to fit within the interior diameter of the central tube.

4. The apparatus as set forth in claim 2 and further including a pair of handles, the pair of handles including a smaller handle having an interior surface with a diameter to be received on the exterior diameter of the first end tube and the a larger handle having an interior surface with a diameter to be received on the exterior of the second end tube, the axial length and exterior diameter of the two tubes being essentially constant.

5. The apparatus as set forth in claim 4 and further including a plurality of projections extending inwardly from the interior surface of each handle for frictional contact with the exterior surface of the end tube upon which it is received for resisting axial movement therebetween.

* * * * *